US005653272A

United States Patent [19]

McCaul

[11] Patent Number: 5,653,272

[45] Date of Patent: Aug. 5, 1997

[54] AUTOMATED BALLOON INFLATION DEVICE

[75] Inventor: Michael F. McCaul, Hopkins, Minn.

[73] Assignee: David C. Nelson of Premium Balloon Accessories, Sharon Center, Ohio

[21] Appl. No.: 382,449

[22] Filed: Feb. 2, 1995

[51] Int. Cl.[6] ..... B65B 31/00

[52] U.S. Cl. ..... 141/314; 141/1; 141/4; 141/46; 141/97; 141/114; 141/197; 141/313; 53/79; 446/220; 194/212; 194/214

[58] Field of Search ..... 141/1, 4, 10, 46, 141/51, 67, 97, 114, 197, 313–317, 173, 392; 194/212, 214; 446/220, 222; 53/79, 84, 88, 403, 459, 469, 385.1, 570; 251/90; D8/349, 354; 70/402, 405, 407, 456 R; 24/3.6

[56] References Cited

U.S. PATENT DOCUMENTS

| | | | |
|---|---|---|---|
| D. 282,048 | 1/1986 | Scanlon | D8/349 |
| D. 333,605 | 3/1993 | Powell, Jr. | D8/349 |
| 1,095,431 | 5/1914 | Sprague | 70/407 |
| 1,329,418 | 2/1920 | Lindberg | 70/407 |
| 1,977,189 | 10/1934 | Larson et al. | 70/407 |
| 3,380,490 | 4/1968 | Ellenberg et al. | 141/173 X |
| 3,536,110 | 10/1970 | West | 141/313 X |
| 3,561,579 | 2/1971 | Allison | 194/219 |
| 3,707,742 | 1/1973 | Justice et al. | 24/3.6 X |
| 4,302,106 | 11/1981 | Taylor | 356/240 |
| 4,319,384 | 3/1982 | Horne | 24/3.6 X |
| 4,389,864 | 6/1983 | Toyoda | 70/456 R |
| 4,509,632 | 4/1985 | Jaffe | 194/214 X |
| 4,587,818 | 5/1986 | Griffin | 24/3.6 X |
| 4,644,984 | 2/1987 | Abraham | 141/392 |
| 4,690,182 | 9/1987 | Knaus | 141/392 |
| 4,847,955 | 7/1989 | Stephens, Jr. | 24/3.6 |
| 4,976,548 | 12/1990 | Tschanz | 224/164 X |
| 5,016,428 | 5/1991 | Helling et al. | 53/403 |
| 5,035,391 | 7/1991 | Steele et al. | 446/220 X |
| 5,067,301 | 11/1991 | Shore | 53/79 |
| 5,118,074 | 6/1992 | Weissman | 251/90 |
| 5,121,595 | 6/1992 | Shore | 53/79 |
| 5,370,161 | 12/1994 | Shafer | 141/114 |
| 5,383,343 | 1/1995 | Thach | 70/456 R X |
| 5,411,427 | 5/1995 | Nelson et al. | 446/71 |

FOREIGN PATENT DOCUMENTS

| | | | |
|---|---|---|---|
| 1507417 | 12/1967 | France | 194/214 |

*Primary Examiner*—J. Casimer Jacyna

*Attorney, Agent, or Firm*—Renner, Kenner, Greive, Bobak, Taylor & Weber

[57] ABSTRACT

An automated balloon inflation device which has a supply of pressurized gas, a nozzle for receiving a balloon, and an actuator for sequentially closing a clamp on the balloon and the nozzle and subsequently supplying the pressurized gas to the balloon for the inflation thereof. Furthermore, a key-weight device may be employed for the dual purpose of controlling the supply of pressurized gas to the nozzle and to prevent the inadvertent loss of an inflated balloon which is secured to the key-weight. Additionally, the automated balloon inflation device is constructed so that any consumer may inflate a balloon with pressurized gas.

21 Claims, 3 Drawing Sheets

AUTOMATED BALLOON INFLATION DEVICE

TECHNICAL FIELD

The invention herein resides generally in the art of automated balloon inflation devices. More particularly, the present invention relates to an automated balloon inflation device in a self-contained enclosure that is safe for consumers to use. Specifically, the present invention relates to a self-contained automated balloon inflation device that is actuated by employing a key-weight device which is preferably secured to the balloon by a ribbon.

BACKGROUND ART

Balloons are known to be used in many different ways. Hot air balloons are employed as recreational devices and for observing ground based activities from a relatively stationary position in the sky. Weather balloons are employed to track atmospheric conditions such as wind speed, barometric pressure and air temperature. One very popular use of balloons is to entertain children at birthday parties, amusement parks and other such events. Typically, balloons are made of latex rubber, non-latex synthetic material or other flexible semi-rigid materials and are usually filled with air or a lighter than air gas such as helium. Recently, the use of helium in non-latex synthetic material balloons with a self sealing valve has become quite popular. Moreover, balloons can be imprinted with various colorful designs to delight children and adults of all ages.

Unfortunately, the use of helium inflated balloons is limited because of the inherent dangers in using a dangerous pressurized gas to inflate the balloons. Moreover, trained personnel are required to operate balloon inflation devices that employ pressurized gas.

Although several automated balloon inflation devices are available there are very few readily usable by the average consumer. Some of these balloon inflating devices require the insertion of the balloon onto a nozzle, which is in communication with the pressurized gas supply, without the benefit of a clamping device to hold the balloon. This lack of a clamping device may allow the dangerous pressurized gas to be misdirected away from the balloon. As such, the balloon may be under inflated. Another detriment to using currently available balloon inflation devices is that the consumer still has direct access to the source of pressurized gas. If the gas is an inert gas, such as helium, it is conceivable that the consumer could become asphyxiated. Furthermore, if a person were to place their mouth directly on the nozzle of the pressurized gas supply, the pressure could severely injure that person's lungs.

There is also an inherent danger in the use of metallic non-latex synthetic balloons filled with a lighter than air gas. It is well known that metallic non-latex synthetic balloons are conductive and that if they come in contact with electrical power lines, the power lines may be shorted out causing a power failure in the immediate area. Another danger of balloons filled with a lighter than air gas is that after the gas escapes, the balloon may settle anywhere in the environment. As a result, the balloon may come in contact with wildlife and cause unnecessary injury or, at the very least, add to undesirable litter. In fact, some states are so concerned with these dangers that legislation has been enacted to require the use of balloon weights to prevent the balloons from aimlessly floating away.

Based upon the foregoing, it is evident that there is a need for an automated balloon inflation device in a self contained enclosure that can be used by the average consumer. Furthermore, there is also a need for an automated balloon inflation device which ensures that a balloon weight is attached to the lighter than air filled balloon so that the balloon complies with the necessary state laws.

DISCLOSURE OF THE INVENTION

In light of the foregoing, it is a first aspect of the present invention to provide an automated balloon inflation device.

Another aspect of the present invention is to provide an automated balloon inflation device in a self-contained enclosure.

Still a further aspect of the present invention is to provide an automated balloon inflation device accessible for use by a consumer.

An additional aspect of the present invention is to provide an automated balloon inflation device for a user, wherein the consumer does not have access to a pressurized gas supply nor any internal components of the device.

Yet an additional aspect of the present invention is to provide an automated balloon inflation device that requires the use of a key-weight before the device can be operated.

A further aspect of the present invention is to provide an automated balloon inflation device which has a door to prevent the consumer from being exposed to any pressurized gas during the balloon inflation process.

Another aspect of the present invention is to provide an automated balloon inflation device such that when the door to the device is being closed a clamping device is activated to hold the balloon onto a nozzle during the inflation process.

Yet a further aspect of the present invention is to provide a nozzle that is flexibly movable with respect to a clamping device Still a further aspect of the present invention is to provide an automated balloon inflation device wherein a pressurized gas supply to inflate the balloon to a desired pressure is only activated upon complete closure of the door.

Yet a further aspect of the present invention is to provide an automated balloon inflation device that is safer than any previously known self-service balloon inflation device.

The foregoing and other aspect of the invention which shall become apparent as the detailed description proceeds, are achieved by an automated balloon inflation device for inflating balloons, comprising: a supply of pressurized gas; a nozzle for receiving a balloon wherein the nozzle is communicative with the pressurized gas; and an actuator which closes a clamp on the balloon and which provides the pressurized gas to the nozzle for inflating the balloon.

The present invention also provides a method of inflating a balloon comprising the steps of: providing a balloon with a neck; providing a balloon inflation device which has a source of pressurized gas, a nozzle communicative with the source of pressurized gas and a clamp operatively controlled by the source of pressurized gas; disposing the neck of the balloon onto the nozzle; and engaging an actuator such that the pressurized gas closes the clamp on the neck and provides the pressurized gas to the nozzle for inflating the balloon.

The present invention also provides another method for inflating a balloon comprising the steps of: providing a housing with a base that separates a cabinet portion from a hood portion, wherein the cabinet portion receives a supply of pressurized gas, wherein said hood portion has a door opening which receives a door, and wherein said panel has a key-weight slot received therein and a clamp and a nozzle secured thereto; inserting a key-weight into the key-weight slot so as to allow pressurized gas to flow through a key-weight valve; disposing a balloon on the nozzle; closing the door which engages a clamp valve and an inflation valve to allow pressurized gas to flow from the key-weight valve to the clamp thereby closing the clamp on the balloon and to allow pressurized gas to flow from the key-weight valve to the nozzle to inflate the balloon; opening the door to disengage the clamp valve and the inflation valve so as to discontinue the flow of pressurized gas to the nozzle and the clamp, thereby disengaging the clamp from the balloon; removing the inflated balloon from the nozzle; and removing the key-weight from the key-weight slot.

BEST MODE FOR CARRYING OUT THE INVENTION

Figure 1:
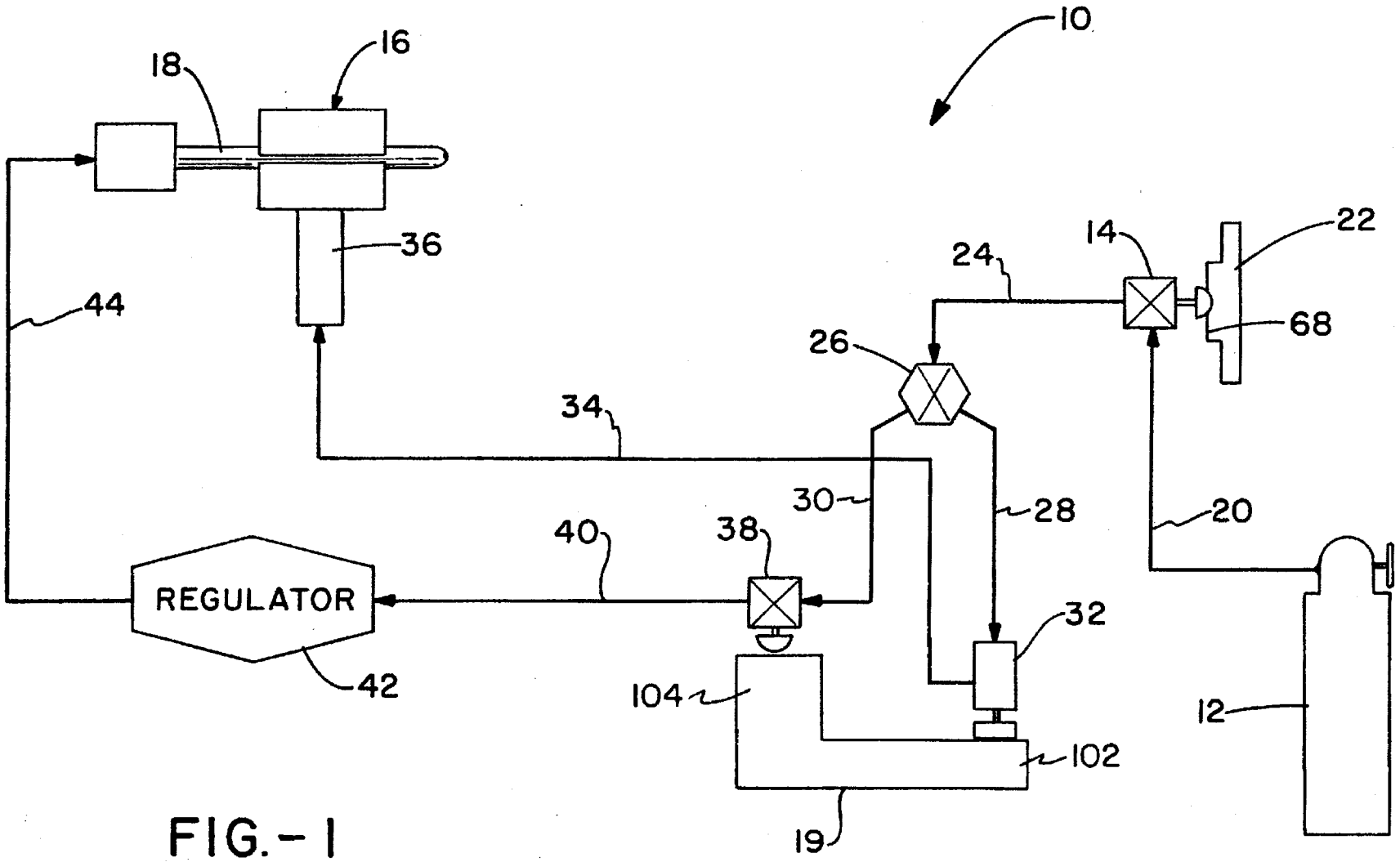
FIG. 1 is a schematic diagram illustrating the operation of an automated balloon inflation device.

Referring now to the drawings and more particularly to FIG. 1, it can be seen that an automated balloon inflation device according to the present invention is designated generally by the numeral 10. Generally, the automated balloon inflation device 10 includes a supply of pressurized gas 12, a key-weight valve 14 communicative with the pressurized gas supply 12, a clamp 16 operatively controlled by the pressurized gas supply 12, a nozzle 18 communicative with the pressurized gas supply 12, and an actuator 19 which provides the pressurized gas 12 to at least the nozzle 18. As will be described in detail hereinbelow, the operator of the device 10 inserts a balloon onto the nozzle 18 and engages the actuator 19 whereupon the clamp 16 secures the balloon to the nozzle 18 so as to allow the source of pressurized gas 12 to inflate the balloon. The drawings are exemplary of a balloon inflation device used with balloons made of metallic polyester resin material sold under the trademark "Mylar," which is owned by the DuPont Corporation. The present invention could also be practiced with any other latex or non-latex synthetic balloon material. Furthermore, although the supply of pressurized gas in the preferred embodiment is helium, the present invention could also be practiced with any type of pressurized gas.

In particular, the pressurized gas supply 12 is connected to a feed line 20 which is operative with the key-weight valve 14. The operation of the key-weight valve 14 is controlled by the insertion of a key-weight into a key-weight slot 22. The key-weight valve 14 is connected to a feed line 24 which is communicative with a splitter valve 26. The splitter valve 26 has two output ports, one of which is connected to a feed line 28 and the other of which is connected to a feed line 30. The opposite end of feed line 28 is connected to a clamp valve 32 which is connected to a feed line 34. The feed line 34 is connected to an air cylinder 36 which operatively controls the position of the damp 16. Those skilled in the art will appreciate that the air cylinder 36 is operable with any type of pressurized gas such as helium. The opposite end of feed line 30 is operatively connected to an inflation valve 38. The inflation valve 38 is connected to a feed line 40 which supplies pressurized gas 12 to a pressure regulator 42. The pressure regulator 42 is connected to a feed line 44 which is communicative with the nozzle 18.

Figure 2:
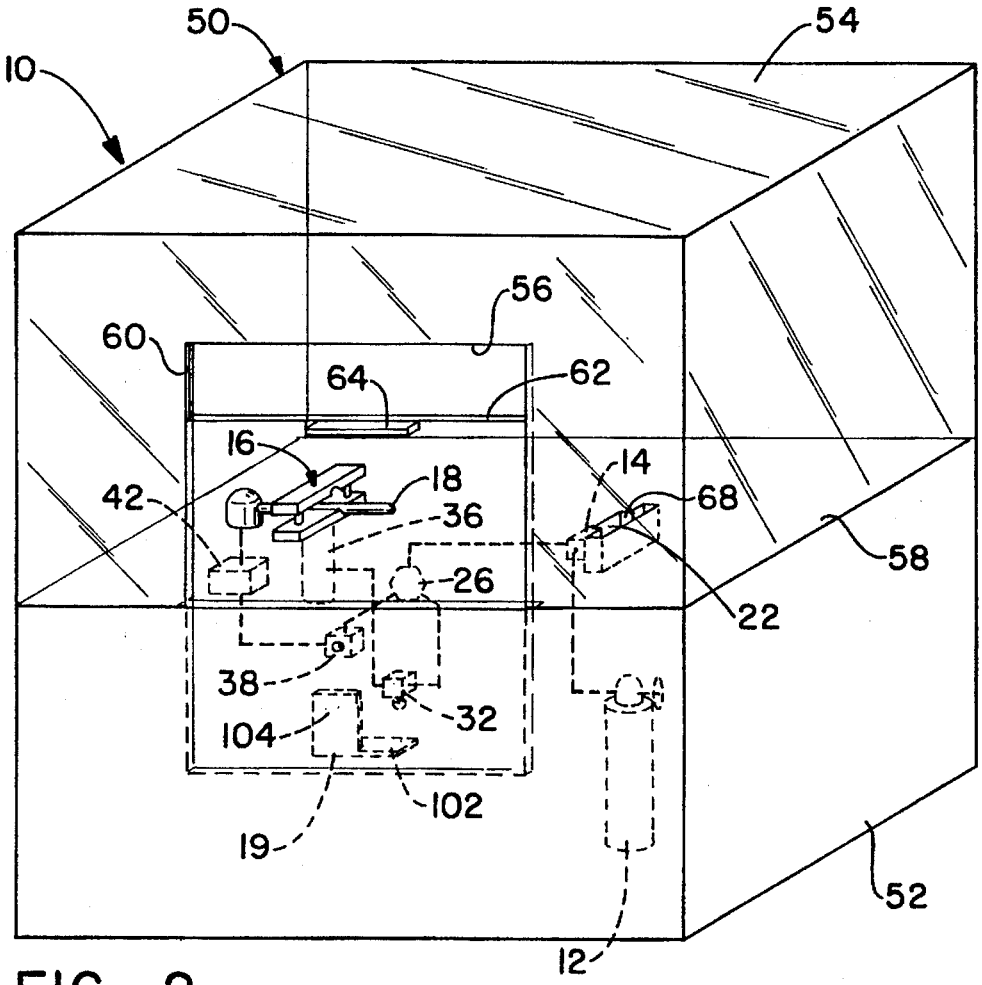
FIG. 2 is a perspective view of a housing which contains the automated balloon inflation device.

Referring now to FIG. 2, it can be seen that the automated balloon inflation device 10 is contained within a housing designated generally by the numeral 50. The housing 50 has a cabinet portion 52 which stores the pressurized gas supply 12, the feed lines 20, 24, 28, 30, 34, 40 and 44, the key-weight valve 14, the splitter valve 26, the clamp valve 32, the air cylinder 36 and the pressure regulator 42. The housing 50 also has a hood portion 54 which has a door opening 56. A base 58 separates the cabinet portion 52 from the hood portion 54. It will be appreciated that the clamp 16 is securably attached to the base 58 and is accessible through the hood portion 54 via the door opening 56. The base 58 has a bore **58*a* through which the nozzle 18 is slidably retained therein. It will further be appreciated that the air cylinder 36 is received within the base 58 so that the air cylinder 36 is cooperative with the clamp 16. The door opening 56 has a plurality of door channels 60 for receiving an access door 62. The access door 62 is slidably moved from an open position to a closed position by exerting a force on a door handle 64. It will also be appreciated that the base 58 has a key-weight slot 22 with a key-weight channel 68. Those skilled in the art will appreciate that the key-weight valve 14 is operatively disposed within the key-weight channel 68**.

Figure 3:
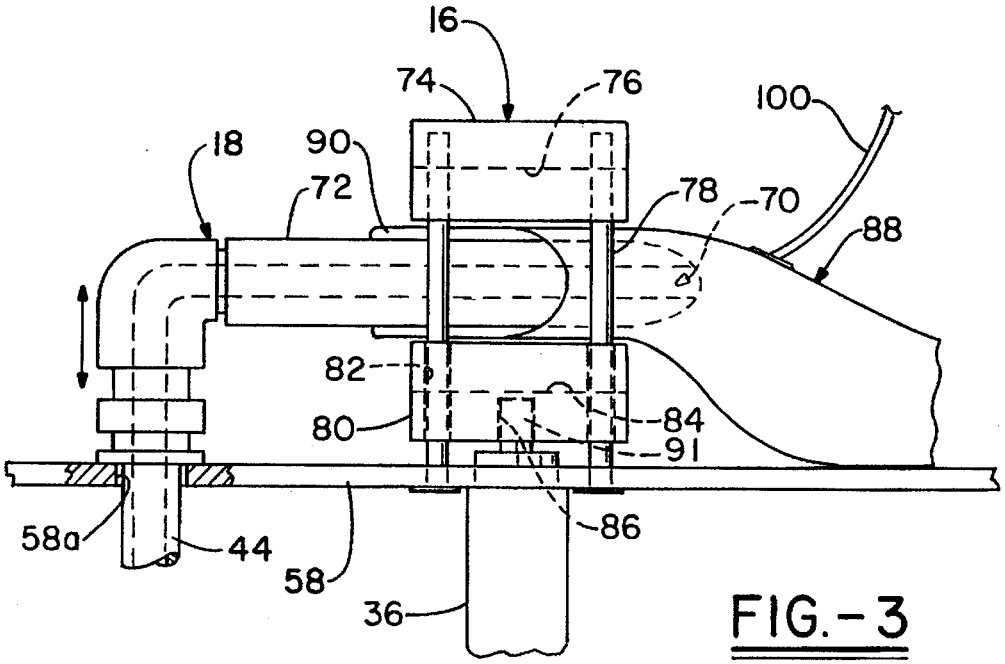
FIG. 3 is an elevational view in partial cross-section, showing the nozzle with a balloon received thereon and a clamping device shown in the open position.

Referring now to FIG. 3, a detailed view of the clamp 16 and the nozzle 18 is shown. In particular, it can be seen that the nozzle 18 is mounted to the base 58 and connected to the feed line 44. The nozzle 18 includes a tubular portion 72 which has a bore or orifice 70. The nozzle 18 is positioned such that it is in a working relationship with the clamp 16.

The clamp 16, shown in the open position, has an upper block 74 with a nozzle receiving portion or channel 76 which conforms to the shape of the nozzle tubular portion 72. A plurality of guide posts 78 are received within the upper block 74 and also within a movable block 80. The movable block 80 has guide holes 82 which slidably receive the guide posts 78. The movable block 80 has a cylinder receiving portion 86 that is operative with the air cylinder 36 which is communicative to feed line 28. The movable block 80 also has a nozzle receiving portion 84 which conforms to the shape of the tubular portion 72. Those skilled in the art will appreciate that the tubular portion 72 receives a balloon 88 there on. The balloon 88 has a neck 90 which snugly fits on to the tubular portion 72.

Figure 4:
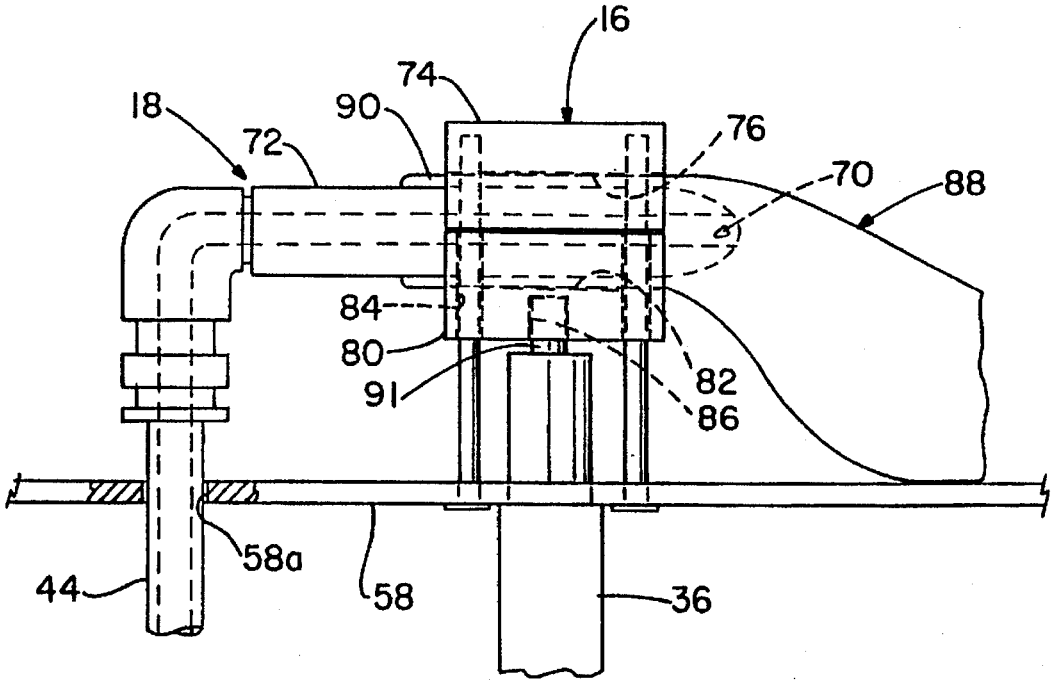
FIG. 4 is an elevational view similar to FIG. 3 illustrating the clamping device in a closed position upon the balloon and the nozzle.

As seen in FIG. 4, when an air cylinder 36 receives a supply of pressurized gas 12 through the feed line 28, a cylinder piston 91 extending into the cylinder receiving portion 86 exerts an upward force on the movable block 80. As a result, the movable block 80 is slidably moved along the guide posts 78 to clamp or firmly secure the neck 90 of the balloon 88 between the movable block 80 and the upper block 74. The nozzle 18, which is slidably movable within the bore **58*a*, slides upward as the nozzle portion 84 engages the tubular portion 72 until the movable block 80 is stopped by the upper block 84. It will be appreciated that the nozzle receiving portions 76 and 84 securely conform around the neck 90 to prevent any inadvertent loss of pressurized gas 12** during the inflation process.

Figure 5:
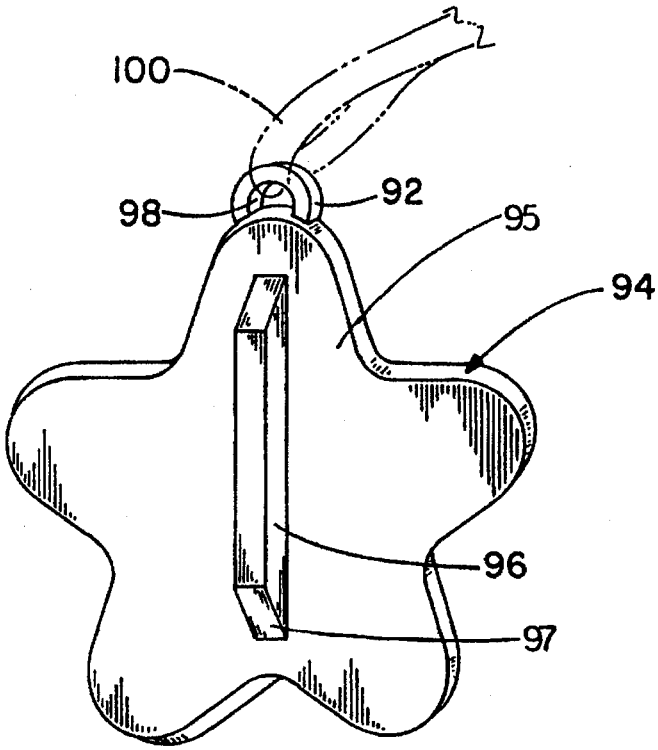
FIG. 5 is a perspective view of a key-weight device used to operate the automated balloon inflation device.

Referring now to FIG. 5, a key-weight, designated generally by the numeral 94, is shown. The key-weight 94 includes a body 95 which has a ridge 96 that extends outwardly therefrom and which is adapted to engage the key-weight valve 14. The ridge 96 has a ramp 97 at one or both ends thereof that is integral with the body 95. The body 95 also has a ring or other means 92 defining a ribbon hole 98 which receives a ribbon 100 therein. It will be appreciated that the opposite end of the ribbon 100 is secured to the neck 90 of the balloon 88. It will further be appreciated that the key-weight 94 is received within the key-weight slot 22 shown in FIG. 2. Furthermore, the key-weight ridge 96 is received within the key-weight channel 68. As such, the key-weight 94 enables an automated balloon inflation device for operation.

Referring again to FIG. 2, it can be seen that the access door 62 carries thereon the actuator 19 which has a clamp activator 102 and a nozzle activator 104. Those skilled in the art will appreciate that as the access door 62 is closed, the clamp activator 102 comes in contact with the clamp valve 32 while a short time later the nozzle activator 104 comes in contact with the inflation valve 38. In the preferred embodiment, the damp valve 32 is a three-way roller valve so that as the access door 62 is opened and closed, the damp valve 32 is gradually opened and closed. By employing a three-way roller valve as clamp valve 32, any gas trapped within the feed line 34 is vented to atmosphere.

In operation, a consumer will purchase an uninflated balloon 88 which is attached to a ribbon 100 that has at its opposite end a key-weight 94. The consumer will insert the key-weight 94 into the key-weight slot 22 so as to activate the key-weight valve 14. The body 95, which has an outwardly extending ridge 96 that is received by the key-weight channel 68, operatively engages (opens and closes) the key-weight valve 14 which is communicative with the pressurized gas supply 12. The ramp 97, which provides a transitional slope between the body 95 and ridge 96, functions to gradually engage the key-weight valve 14. In other words, the ramp 97 makes first contact with the key-weight valve 14 as it is inserted into the key-weight channel 68 and the ridge 96 holds the key-weight valve 14 in an enabling position once it is fully inserted. By engaging the key-weight valve 14 with the ridge 96, the pressurized gas flows from the supply 12 through the feed lines 20 and 24 to the splitter valve 26. Meanwhile, the consumer will insert the balloon neck 90 onto the tubular portion 72 of the nozzle 18. In the preferred embodiment, the balloon 88 has a one-way valve which allows pressurized gas to enter, but not exit, the balloon. After the balloon has been disposed on the nozzle 18, the consumer spreads the balloon 88 out so that it inflates evenly.

Afterwards, the consumer slidably moves the access door 62 and the actuator 19 carried thereon into a closed position such that the clamp activator 102 engages the clamp valve 32 and the nozzle activator 104 engages the inflation valve 38. Those skilled in the art will appreciate that the gas 12 then flows from the feed line 28 through the clamp valve 32, through the feed line 34 to the air cylinder 36. At this time, the air cylinder 36 is actuated by the pressurized gas supply and causes the cylinder piston 91 contained therein to forcibly move the movable block 80, which slidably moves the nozzle 18, along the guide posts 78 into mating contact with the upper block 74 so as to clamp around the balloon neck 90 and the nozzle tubular portion 72. Subsequently, when the nozzle activator 104 engages the inflation valve 38, the pressurized gas 12 flows through the feed lines 30 and 40 to the pressure regulator 42. From the pressure regulator 42, the gas 12 flows through the feed line 44 then into the orifice 70 and into the balloon 88 for the inflation thereof. Those skilled in the art will appreciate that the pressure regulator 42 is set at a predetermined pressure such that the balloon secured to the nozzle 18 does not over inflate.

As best seen in FIG. 2, it is apparent that the damp activator 102 and the nozzle activator 104 are carried on the access door 62 in a manner that allows sequential activation of the clamp 16 before pressurized gas 12 is supplied to the nozzle 18. This is done so that the pressurized gas 12 does not force the balloon 88 off of the nozzle 18 before the clamp 16 is engaged. This feature also prevents the inadvertent emission of pressurized gas 12 into the hood portion 54 of the housing 50.

After the balloon 88 has inflated to the preselected pressure as set by the pressure regulator 42, the consumer opens the access door 62 so as to disengage the clamp activator 102 from the clamp valve 32 and also to disengage the nozzle activator 104 from the inflation valve 38. As should be apparent from the above description, the pressurized gas 12 stops flowing to the nozzle 18 and subsequently the pressurized gas 12 stops flowing to the air cylinder 36 so as to release clamping pressure from the balloon neck 90 so that the damp 16 and nozzle 18 return to their starting position. As the damp valve 32 is opened, any gas within the feed line 34 is quickly released to atmosphere. Afterwards, the consumer reaches into the hood portion 54 through the door opening 56, removes the balloon 88 from the nozzle 18 and withdraws the key-weight 94 from the key-weight slot 22.

In the preferred embodiment, the hood portion 54 is constructed of an optically clear material such as glass or plastic so that the consumer can see the balloon 88 during the inflation process. This allows the consumer to quickly ascertain whether the balloon 88 is properly installed on the nozzle 18 and whether the damp 16 has properly secured the balloon 88. If the balloon is not properly secured in the clamp 16, the consumer can open the access door 62 and reaffix the balloon 88 to the nozzle 18. It will also be appreciated that the cabinet portion 52 contains the necessary pressurized gas supply 12 and all of the inner workings of the automated balloon inflation device 10 so that they are not accessible to the consumer. The structure of device 10 greatly decreases the consumers access to the pressurized gas supply 12. In the preferred embodiment, the pressurized gas supply is helium, although any other lighter than air gas could be used.

It is apparent then from the above description of the operation of the automated balloon inflation device 10 that the problems associated with the previous balloon inflation devices have been overcome. In particular, the balloon inflation device 10 is convenient and safe to use by virtue of the fact that the pressurized gas supply and all of the inner workings are inaccessible to the consumer. Furthermore, by only allowing the inflation process to occur when the access door 62 has dosed the hood portion 54, the consumer is prevented from inadvertently inhaling the pressurized gas. As such, the danger of the consumer becoming asphyxiated or of having their lungs injured is virtually eliminated.

Another advantage of the automated balloon inflation device 10 is the requirement that the key-weight 94 be inserted into the key-weight slot 22 before the operation of the device 10 can commence. This particular feature has several advantages. First, it ensures that a key-weight 94 is used with a balloon 88 that is going to be filled with a lighter than air gas. As such, the possibility of a helium filled metallic non-latex synthetic material balloon interfering with electrical power lines and the possibility of such a balloon harming the environment is greatly reduced.

Furthermore, the key-weight 94 prevents the inflated balloon 88 from inadvertently floating away to the distress of the person holding the balloon. Another advantage of the automated balloon inflation device 10 is that the pressure regulator 42 prevents the balloon 88 from over inflating. This is accomplished even if the access door 62 remains dosed for an extended period of time. Of course, an embodiment of this device could be operated without requiring the use of a key-weight 94.

Of course, other alternative embodiments of the present invention are possible. In a first alternative embodiment, the nozzle 18 has a flexible tubular portion 72 so that the nozzle 18 may be secured to the base 58. As a result, the tubular portion 72 is already in contact with either the nozzle receiving portion 76 or 84 prior to the clamping operation. This embodiment reduces the amount of wear on the clamp 16 and the nozzle 18.

It will also be appreciated that other clamping devices could be employed to secure a balloon to a nozzle during the inflation process. Instead of movable blocks securing the balloon, it is conceivable that cylinder-actuated calipers could secure the balloon to the nozzle. Additionally, the damping device could be directly secured to the door actuator so that as the door is closed, a clamp pivotally secures the balloon to the nozzle, whereupon the inflation process is started.

Thus, it can be seen that the objects of the invention have been satisfied by the structure presented above. It should be apparent to those skilled in the art that the objects of the present invention could be practiced with any type of balloon or adapted to perform with any type of pressurized gas.

While the preferred embodiment of the invention has been presented and described in detail, it will be understood that the invention is not limited thereto or thereby. Especially in that various materials and configurations may be used in the construction of the invention to meet the various need of the consumer. Accordingly, for an appreciation of the true scope and breadth of the invention, reference should be made to the following claims.

What is claimed is:

1. An automated balloon inflation device for inflating balloons comprising:

a balloon;

a retrievable key-weight;

a supply of pressurized gas;

a nozzle for receiving said balloon wherein said nozzle is communicative with said pressurized gas;

a clamp closable on said balloon and said nozzle, wherein said clamp is communicative with said pressurized gas;

a clamp valve operatively engaged by a movable door to allow said pressurized gas to flow to said clamp for actuation thereof; and a key-weight valve interconnected between said pressurized gas and both said nozzle and said clamp, said key-weight valve operatively engaged by said retrievable key-weight to allow said pressurized gas to flow to said clamp to close said clamp on said balloon and to said nozzle to inflate said balloon, the flow of said pressurized gas stopping when said retrievable key-weight is withdrawn from contact with said key-weight valve.

2. A device according to claim 1, further comprising:

an air cylinder actuated by said supply of pressurized gas wherein said air cylinder is operative with said clamp for the selective closure thereof, wherein said clamp valve is interconnected between said pressurized gas and said air cylinder, said clamp valve operatively engaged by said movable door to allow said pressurized gas to flow to said air cylinder to close said clamp on said balloon.

3. A device according to claim 1, further comprising a pressure regulator operatively disposed between said nozzle and said supply of pressurized gas, wherein said pressure regulator is set to a pre-selected pressure such that the pressure within said balloon does not exceed said pre-selected pressure during inflation.

4. A device according to claim 1, wherein said nozzle and said clamp are contained within a hood portion which has an opening such that said clamp and said nozzle are accessible through said opening.

5. A device according to claim 4, further comprising an inflation valve interconnected between said pressurized gas and said nozzle wherein said movable door is received within said opening and engages said inflation valve and allows said pressurized gas to flow to said nozzle.

6. A device according to claim 5, wherein when said door closes said opening said actuator sequentially allows said pressurized gas to flow to close said clamp and subsequently allows said pressurized gas to flow to said nozzle for inflating said balloon, and wherein when said door is opened said inflation valve stops said pressurized gas flow to said nozzle and said clamp valve subsequently stops said pressurized gas flow to said clamp to open said clamp.

7. A device according to claim 6, wherein said hood portion has a key-weight slot with a key-weight channel for receiving said retrievable key-weight.

8. A device according to claim 7, wherein said retrievable key-weight has a ridge so that said ridge is received by said key-weight channel such that said ridge operatively allows said pressurized gas to flow through said key-weight valve.

9. A device according to claim 8, wherein said pressurized gas is helium.

10. A device according to claim 9, wherein said balloon is made of non-latex synthetic material and secured to one end of a ribbon, and wherein the opposite end of said ribbon is secured to said retrievable key-weight.

11. A method of inflating a balloon comprising the steps of:

providing a balloon with a neck;

providing a retrievable key-weight secured to said balloon;

providing a balloon inflation device which has a source of pressurized gas, a nozzle communicative with said source of pressurized gas, and a clamp;

disposing said neck of said balloon onto said nozzle;

engaging a key-weight valve communicative with said source of pressurized gas with said retrievable key-weight such that said pressurized gas is provided to said clamp which secures said balloon to said nozzle and to said nozzle for inflating said balloon; and withdrawing said retrievable key-weight from engagement with said key-weight valve to stop the flow of said pressurized gas to said nozzle and to said clamp to release said balloon from said clamp.

12. A method as set forth in claim 11, further including the steps of:

disposing a pressure regulator operatively between said source of pressurized gas and said nozzle, wherein said pressure regulator prevents said balloon from being over-inflated; and disposing an air cylinder operatively between said source of pressurized gas and said clamp, wherein said air cylinder is operative with said clamp for the selective closure thereof.

13. A method as set forth in claim 12, further including the steps of:

providing a hood portion that contains said nozzle and said clamp, which are accessible through an opening which has a door;

providing a clamp valve communicative with said source of pressurized gas and said air cylinder, said clamp valve actuated by said door; and closing said door to engage said clamp valve to allow pressurized gas to flow to said clamp through said air cylinder.

14. A method as set forth in claim 13, wherein said pressurized gas is helium.

15. A retrievable key-weight and an automated balloon inflation machine, comprising:

an automated balloon inflation machine having a key-weight valve;

a balloon; and a retrievable key-weight secured to said balloon, said retrievable key-weight comprising a body to engage said key-weight valve to initiate the operation of said automated balloon inflation machine and wherein said retrievable key-weight is withdrawn from contact with said key-weight valve to stop operation of said automated balloon inflation machine.

16. The combination according to claim 15, further comprising a ridge outwardly extending from said body wherein said ridge is operative to open and close said key-weight valve so as to enable the automated balloon inflation device.

17. The combination according to claim 16, wherein said ridge has a ramp on at least one end thereof.

18. The combination to claim 17, wherein said retrievable key-weight further comprises a ring extending from said body, said ring having a ribbon secured thereto.

19. An automated balloon inflation device for inflating balloons, comprising:

a supply of pressurized gas;

a nozzle connected to said pressurized gas, said nozzle receiving a balloon;

a clamp connected to said pressurized gas, said clamp having a pair of opposed blocks closable around said nozzle and the balloon received thereon for holding the balloon thereto;

door means for allowing access to said nozzle and said clamp, said door means, when closed, engaging at least one valve interposed between said pressurized gas and one of said clamp and said nozzle to allow actuation thereof; and means for transferring said pressurized gas first to said clamp to close said pair of opposed blocks on the balloon and said nozzle and subsequently transferring said pressurized gas to said nozzle to inflate the balloon, wherein upon completion of the balloon inflation said transferring means subsequently stops the flow of said pressurized gas to said nozzle and subsequently to said clamp which releases said opposed blocks from around the balloon and said nozzle.

20. The device according to claim 19, said door means comprising:

a housing having a cabinet portion for receiving said pressurized gas and a hood portion having a door, said clamp and said nozzle accessible within said hood portion when said door is open;

a plurality of valves interconnected between said pressurized gas and both said nozzle and said clamp; and an actuator connected to said door and engaging said plurality of valves to close said pair of opposed blocks on the balloon and then inflate the balloon only upon closure of said door and disengaging said plurality of valves to stop inflating the balloon and opening said pair of opposed blocks when said door is opened.

21. The device according to claim 20, wherein said nozzle has a tubular portion with an orifice extending therethrough, said orifice connected to said pressurized gas and wherein each of said opposed blocks has a nozzle receiving portion which conforms to the shape of said tubular portion.

* * * * *